US005406706A

United States Patent [19]

Nagai

[11] Patent Number: 5,406,706

[45] Date of Patent: Apr. 18, 1995

[54] MANUFACTURING METHOD OF THE BODY OF A CALIBER ROLL

[75] Inventor: Masayuki Nagai, Suita, Japan

[73] Assignee: Sumitomo Metal Industries, Ltd., Osaka, Japan

[21] Appl. No.: 288,456

[22] Filed: Aug. 10, 1994

Related U.S. Application Data

[62] Division of Ser. No. 102,952, Aug. 6, 1993, Pat. No. 5,359,773, which is a division of Ser. No. 833,527, Feb. 11, 1992.

[30] Foreign Application Priority Data

Dec. 5, 1991 [JP] Japan ..... 3-349698

[51] Int. Cl.[6] ..... B23P 15/00

[52] U.S. Cl. ..... 29/895.33; 29/895.21; 492/34

[58] Field of Search ..... 29/895.21, 895.3, 895.33, 29/895.212; 492/34, 35, 40, 53, 58

[56] References Cited

U.S. PATENT DOCUMENTS

| | | | |
|---|---|---|---|
| Re. 28,868 | 6/1976 | Sparder, Jr. | 29/895.21 |
| 692,478 | 2/1902 | Robbins et al. . | |
| 3,218,691 | 11/1965 | Carroll . | |
| 3,609,849 | 10/1971 | Krol . | |
| 3,793,869 | 2/1974 | Hufnagl et al. . | |
| 3,820,212 | 6/1974 | Sparder, Jr. | 29/895.21 |
| 3,842,471 | 10/1974 | Polhall et al. . | |
| 4,000,010 | 12/1976 | Sekmoto et al. | 29/895.33 |
| 4,674,312 | 6/1987 | Cook . | |
| 4,777,822 | 10/1988 | Uemura et al. . | |
| 4,817,410 | 4/1989 | Yatsuzuka et al. . | |
| 4,819,471 | 4/1989 | Cook . | |
| 4,961,261 | 10/1990 | Kojmad et al. | 29/895.21 |
| 5,225,007 | 7/1993 | Hattori et al. | 29/895.3 |

FOREIGN PATENT DOCUMENTS

| | | | |
|---|---|---|---|
| 54-157757 | 12/1979 | Japan . | |
| 55-28358 | 2/1980 | Japan . | |
| 55-70406 | 5/1980 | Japan . | |
| 56-86611 | 7/1981 | Japan . | |
| 59-2561 | 1/1984 | Japan . | |
| 61-136658 | 6/1986 | Japan . | |
| 61-216807 | 9/1986 | Japan . | |
| 62-109926 | 5/1987 | Japan . | |
| 63-101012 | 5/1988 | Japan . | |
| 64-11945 | 1/1989 | Japan . | |
| 1053708 | 3/1989 | Japan . | |
| 2-307607 | 12/1990 | Japan . | |
| 2-307608 | 12/1990 | Japan . | |
| 4-100615 | 4/1992 | Japan . | |
| 4-172113 | 6/1992 | Japan . | |
| 64944 | 3/1971 | Luxembourg . | |
| 555961 | 4/1977 | U.S.S.R. . | |
| 0741971 | 6/1980 | U.S.S.R. | 29/895.21 |
| 1488043 | 6/1989 | U.S.S.R. . | |

OTHER PUBLICATIONS

P. I. Polukhin et al., "*Steels for Tube Mill Rolls*", Chemaya Metallurgiya, 1975 (10), 61–64 pp. 556–557 (Oct. 1975).

*Primary Examiner*—Irene Cuda

*Attorney, Agent, or Firm*—Burns, Doane, Swecker & Mathis

[57] ABSTRACT

A caliber roll for rolling consisting of a roll main body having a caliber on the outer circumference and provided with a shaft hole penetrating in the shaft central direction, and a roll shaft inserted into the shaft hole of the roll main body, in which a compressive stress in the widthwise direction of the roll main body is applied to the bottom of the caliber. This compressive stress is applied by forming either the inner circumference of the roll main body or the circumference of the roll shaft in a taper, and shrinkage-fitting or cold-fitting the roll main body and the roll shaft, or by pressing the both end faces in the widthwise direction of the roll main body by means of pressing jig fixed to the roll shaft. Besides, a recess gap is provided in either one or both of the inner circumference in the middle of th widthwise direction of the roll main body and the corresponding circumference of the roll shaft. The roll main body is composed of an iron-based alloy including, by weight, C: 0.75 to 1.75%, Si: 3.0% or less Mn: 2.0% or less, P: 0.030% or less, S: 0.030% or less, Cr: 5.0 to 13.00%, Mo: 0.80 to 5.0%, and V: 0.1 to 0.5%, in which the entire hardness is adjusted to $H_RC$ 52 to 56, and the metal flow is in the shaft central direction.

13 Claims, 21 Drawing Sheets

MANUFACTURING METHOD OF THE BODY OF A CALIBER ROLL

This application is a divisional of application Ser. No. 08/102,952, filed Aug. 6, 1993 and which is a divisional application of application Ser. No. 07/833,527, filed Feb. 11, 1992.

BACKGROUND OF THE INVENTION

1. Field of the Invention

The present invention relates to a caliber roll for rolling consisting a roll main body and a roll shaft, used in caliber rolling of tubes and bars, and a manufacturing method of its roll main body, and more particularly to a caliber roll for rolling possessing a sufficient abrasion resistance and crack resistance characteristic and having an excellent service life, and a manufacturing method of its roll main body.

2. Description of the Related Art

A caliber roll for rolling used in caliber rolling of tubes and bars has, as shown in FIG. 1, a hollow roll main body 1 having a caliber 1*a*, and a roll shaft 2 tightly fitted into a shaft hole 1*b* of the roll main body 1. In the case of this caliber roll for rolling, when rolling, a tensile stress $\sigma_t$ acts on the bottom section of the caliber 1*a* of the roll main body 1, due to the surface pressure P acting on the caliber 1*a* of the roll main body 1. The distribution of this tensile stress $\sigma_t$ reaches the maximum on the bottom surface of the caliber 1*a*, and supposing this maximum value to be $\sigma_{tmax}$, the surface pressure P is high depending on the rolling condition, and $\sigma_{tmax}$ rises, and when this $\sigma_{tmax}$ exceeds the material strength of the roll main body 1, the bottom surface of the caliber 1*a* is cracked, and thereby the roll main body 1 is broken. Besides, the bottom surface of the caliber 1*a* of the roll main body 1 is likely to be cracked because it is exposed to cyclic thermal stresses of processing heat and cooling by lubricating oil.

As the countermeasure of roll breakdown, hitherto, the roll material is changed to a stronger material, but the roll cost rises, and generally the higher the strength, the lower becomes the toughness, and cracks due to impact are more likely to occur.

As other method, a gap is provided in the contact surfaces of the roll main body 1 and roll shaft 2 (Japanese Patent Application Publication No. 59-2561, U.S. Pat. No. 4,874,312 (Japanese Patent Application Laid-Open No. 61-216807)). These methods are intended to lessen the tensile stress on the bottom surface of the caliber 1*a* caused by rolling force, by forming a recess in the middle part of the roll main body 1 or in the corresponding position of the roll shaft 2, and deflecting the roll by the vertical components of the surface pressure while rolling, thereby generating a compressive stress on the bottom surface of the caliber 1*a*. That is a bending stress is generated in the bottom section of the caliber 1*a* by rolling reaction, and this bending stress acts as a compressive stress on the bottom surface of the caliber 1*a*, and by this compressive stress, the tensile stress maximum value $\sigma_{tmax}$ is reduced, hence preventing breakdown.

However, even by the method of forming a recess in the middle part of the roll main body 1 or in its corresponding position of the roll shaft 2, crack and roll breakdown could not be sufficiently prevented owing to the following reasons.

FIG. 2 shows an example of roll peripheral direction distribution of vertical component (roll reaction) P of surface pressure applied to the caliber roll of cold Pilger rolling mill forming a caliber gradually decreasing in the radius in the peripheral direction, mean tensile stress $\sigma_H$ of caliber bottom section and tensile stress $\sigma_T$ of caliber bottom surface (corresponding to $\sigma_{tmax}$ in FIG. 1) caused by it, in which the axis of abscissas denotes the position in the roll peripheral direction, and the axis of ordinates is the roll reaction and tensile stress. That is, according to this diagram, the roll reaction P reaches the maximum near section No. 0.3 in the roll peripheral position, the mean tensile stress $\sigma_H$ reaches the maximum nearly at the maximum position of the roll reaction P, and the tensile stress $\sigma_T$ of caliber bottom surface reaches the maximum nearly at section No. 0.55.

The reason of deviation of the maximum position of the tensile stress $\sigma_T$ of caliber bottom surface in the rightward direction or in the caliber radius decreasing direction, with respect to the roll reaction maximum position, is as follows. The mean tensile stress $\sigma_H$ increases as the roll reaction becomes larger, but even at the same roll reaction, as the caliber radius becomes smaller, the two, as shown in the diagram, the maximum position of the tensile stress $\sigma_T$ of caliber bottom surface increases due to stress concentration, and by the effects of the tensile stress $\sigma_T$ of caliber bottom surface is deviated to the caliber radius smaller side. Meanwhile, the multiple breakdown forming region of the caliber roll for rolling in the diagram coincides with the maximum position of the tensile stress $\sigma_T$ of caliber bottom surface.

In the caliber roll for rolling showing such distribution, when the above recess forming technology is applied, the compressive stress generated on the roll caliber bottom surface depends on the roll reaction force itself, and therefore the compressive force generated at the maximum position of the tensile stress of caliber bottom surface is smaller than the compressive stress generated at the maximum position of the roll reaction, and hence the effect by the compressive stress at the maximum position of the tensile stress of caliber bottom surface is small, thereby leading to roll breakage.

The material of the roll main body of the caliber roll for rolling is explained below.

Conventionally, the roll main body of caliber roll for rolling was generally made of SUJ5 steel specified as bearing steel in JIS, or high carbon low alloy tool steel such as 0.8%C-1.75%Cr-0.3%Mo-0.1%V steel (hereinafter the percentage expressing the content of components is wt. %). However, the high carbon low alloy steels are not sufficient in hardening, and large in fluctuations of hardness due to uneven hardening and mass effect, and are likely to cause wear and crack depending on application conditions. For hardening, therefore, instead of hardening the entire section of the roll, a technique called cored hardening for hardening only the surface layer by special heat treatment has been employed. In the roll fabricated by cored hardening, since the hardened portion is only the surface layer, the abrasion resistance is maintained only for a short term, and when the caliber surface layer is worn to a certain extent, the hardness of the caliber surface suddenly drops, thereby leading to collapse of the caliber shape.

Accordingly, as the material of the roll main body, the JIS SKD11 steel (high carbon high alloy tool steel) with excellent hardenability has come to be used. The roll made of this high carbon high alloy tool steel is excellent in hardenability and can be hardened entirely, and special treatment such as cored hardening is not needed. However, the roll main body made of SKD11 steel is required to have a hardness of $H_RC$ 60 or more (Rockwell C scale) from the viewpoint of prevention of caliber abrasion and surface spalling. To endow with such hardness, however, as clear from the tempering temperature curve in FIG. 3, for example, after hardening at 1030° C., tempering must be done at a low temperature of about 200° C. Accordingly, the subsequent heating temperature range is limited, and not only the temperature control is difficult at the time of shrinkage-fitting to the roll shaft, but also softening may be possibly caused by processing heat or abrasion heat in rolling. Furthermore, this SKD11 steel is not sufficient in toughness, and when applied in the roll main body, it is indicated that the caliber is likely to be broken from the bottom during rolling.

In this background it was once proposed to use a cold tool steel (C: 0.75 to 1.75%, Si: 3.0% or less, Mn: 0.1 to 2.0%, P: 0.020% or less, S: 0.003% or less, Cr: 5.0 to 11.0%, Mo: 1.3 to 5.0%, V: 0.1 to 5.0%, N: 0.020% or less, O: 0.0030% or less) with an attempt to enhance the toughness while maintaining the high hardness of the SKD11 steel, on the basis of the SKD11 steel, by decreasing the contents of P, S, O and N, and increasing the content of Mo (Japanese Patent Application Laid-Open No. 64-11945). This steel (hereinafter calls SKD11 modified steel) is superior to SKD11 steel in toughness, realizes the tempering effect by heating at 450° C. or higher, and east in temperature control in shrinkage-fitting, and free from risk of softening due to processing heat during use, but the following problems are known.

That is, the SDK11 modified steel (the cold tool steel disclosed in the Japanese Patent Application Laid-Open No. 64-11945) mainly features the resistance to abrasion by allowing to be used at high hardness by the portion of the superior toughness, and accordingly when applied in the roll main body of the caliber roll for rolling, the appropriate hardness is said to be $H_RC$ 62 to 63. However, if a high impact load is applied as in the caliber roll for rolling, even by application of the SKD11 modified steel, it is difficult to prevent cracks from the caliber bottom, and this tendency is more obvious when used at such high hardness.

Besides, in this SKD11 modified steel, in order to maintain the material hardness of $H_RC$ 62 or 63, the tempering temperature must be 490° to 530° C. in the case of 1030° C. hardening, but as clear from FIG. 3 this is the temperature range before and after the secondary hardening temperature, and even in this temperature range, if exceeding the secondary hardening temperature, the hardness drops suddenly, and such hardness cannot be maintained stably. Therefore, usually, the tempering temperature is below the secondary hardening temperature, and the tensile residual stress of the surface layer (generated as the surface shrinks at the time of cooling when hardening) and residual austenite (expanding by martensiting with the lapse of time) are not eliminated, thereby leaving the factors of cracks.

Thus, in the conventional caliber roll for rolling, the roll wear was excessive, and it was required to adjust the roll gap (adjust the outside diameter) frequently depending on the extent of roll wear, and to prepare the mandrels differing in size (adjust the product wall thickness), and short life of the roll and other problems were not sufficiently solved.

SUMMARY OF THE INVENTION

The present inventors intensively researched, from such viewpoint, in order to present a caliber roll for rolling having a sufficiently satisfactory life (crack life, wear life), and realize tube making works without requiring frequent tasks for product size adjustment or preparation of mandrels in multiple sizes, and obtained the following findings.

That is, the SKD11 steel and SKD11 modified steel which are superior in hardening operation and abrasion resistance to other existing materials and are easy to obtain among cold tool steels are, when used as the material for the roll main body of the caliber roll for rolling, indeed likely to cause large cracks if prepared at high hardness according to the conventional tempering standard as mentioned above, and likely to cause wear, spalling and crack if prepared at low hardness.

Nevertheless, such "large cracks" do not depend on the hardness alone, but are also largely influenced by the material metal flow, residual stress and residual austenite. Therefore, by positively controlling the metal flow in the roll shaft central direction, and tempering after hardening in a temperature range above the secondary hardening temperature (see FIG. 3), effects of nonmetallic inclusions and giant carbides along the metal flows may be suppressed, and the residual stress is eliminated by high temperature tempering, and moreover as shown in FIG. 4 the residual austenite is lost, and the crack tendency is extremely lowered. In addition, when tempered at high temperature above the secondary hardening temperature, the hardness is reduced to $H_RC$ 52 to 56, but the wear resistance is not practically so lowered as compared with that at $H_RC$ 57 to 63 achieved in the treatment conforming to the conventional tempering standard.

Accordingly, selecting the SKD11 steel and SKD11 modified steel as the materials, by setting up positive measures for controlling the metal flow in the roll shaft central direction, and tempering at high temperature above the secondary hardening temperature after hardening to adjust the hardness in a range of $H_RC$ 52 to 56, it is possible to realize a caliber roll for rolling possessing sufficient crack resistance and wear resistance, being free from adverse effects at the time of shrinkage-fitting to the roll shaft and risk of softening by processing heat and abrasion heat in rolling.

It is hence an object of the invention to present a caliber roll for rolling possessing excellent wear resistance and crack resistance and a manufacturing method of its roll main body.

It is other object of the invention to present a caliber roll for rolling that is easy to handle and long in service life and a manufacturing method of its roll main body.

It is another object of the invention to present a caliber roll for rolling at low cost and a manufacturing method of its roll main body.

The caliber roll for rolling of the invention comprises a roll main body having a caliber on the outer circumference and possessing a shaft hole penetrating in the shaft central direction, and a roll shaft inserted in the shaft hole of the roll main body, in which the compressive stress in the widthwise direction of the roll main body is applied to the bottom of the caliber. When the compressive stress in the widthwise direction of the roll main body is applied thus to the bottom of the caliber of the roll main body, the maximum value of the tensile stress of the caliber bottom surface which causes crack or breakdown is lowered.

This compressive stress is applied by tapering either the internal circumference of the roll main body or the circumference of the roll shaft, and shrinkage-fitting or cold-fitting the roll main body and roll shaft. Or the compressive stress is applied by pressing the both end faces of the roll main body in the widthwise direction by means of a pressing jig fixed on the roll shaft.

A recess gap is disposed in either widthwise central internal circumference of the roll main body or its corresponding circumference of the roll shaft, or in both. By deflection of the roll by this recess gap, the compressive stress is generated in the bottom part of the caliber of the roll main body, and a greater compressive stress is applied to the bottom of the caliber of the roll main body.

The roll main body is made of an iron-based alloy including, by weight, C: 0.75 to 1.75%, Si: 3.0% or less, Mn: 2.0% or less, P: 0.030% or less, S: 0.030% or less, Cr: 5.0 to 13.00%, Mo: 0.80 to 5.0%, and V: 0.1 to 0.5%, and the entire hardness is adjusted to $H_RC$ 52 to 56, and it possesses a metal flow in the shaft central direction. The reasons of defining the chemical composition of the iron-based alloy as the material for the roll main body, the entire hardness of the roll main body, and the direction of metal flow as mentioned above are explained below.

The material steel used in the roll main body of the caliber roll for rolling is, for the sake of availability, desired to be in a composition range corresponding to the JIS SKD11 steel including C: 1.40 to 1.60%, Si: 0.40% or less, Mn: 0.60% or less, P: 0.030% or less, S: 0.030% or less, Cr: 11.00 to 13.00%, Mo: 0.80 to 1.20%, and V: 0.20 to 0.50%, and also allowable components such as Ni as required. Also from the viewpoint of maintaining the toughness, reducing P, S, O and N from the above composition, it is more preferable to define in the composition range of the SKD11 modified steel including C: 0.75 to 1.75%, Si: 3.0% or less, Mn: 0.1 to 2.0%, P: 0.020% or less, S: 0.003% or less, Cr: 5.0 to 11.0%, Mo: 1.3 to 5.0%, V: 0.1 to 0.5%, N: 0.020% or less and O: 0.0030% or less.

C, aside from heightening the hardness of martensite, acts to improve the wear resistance by forming a carbide together with Cr, Mo and V, but if its content is less than 0.75%, the desired effect by such action is not expected, or if contained more than 1.75%, the toughness is lowered, and hence the content of C is defined within 0.75 to 1.75%. Si is a useful component as a deoxidizer of steel, and at the same time it is effective for increasing the hardness of high temperature tempering. If contained excessively, however, the hot processability and toughness are lowered, and the upper limit of the Si content is defined at 3.0%. Mn is a useful component as deoxidizing and desulfurizing agent of steel, and at the same time it is also effective for improvement of hardenability. If contained excessively, however, the processibility is lowered, and hence the upper limit of the Mn content is defined at 2.0%. As the P content increases, the toughness of steel is lowered, and the upper limit of the P content is defined at 0.030%. If the S content is excessive, the impact value of the steel declines, and the upper limit of the S content is defined at 0.030%. Cr is dissolved in the matrix in hardening to enhance the hardenability, and also forms a Cr carbide to improve the wear resistance, but if the content is less than 5.0%, the desired effect by its action is not obtained, or if contained more than 13.00%, the toughness deteriorates, and hence the Cr content is defined within 5.0 to 13.00%. Mo is dissolved in the matrix in hardening and forms a carbide to improve the wear resistance, and also acts to enhance the hardening and tempering resistance, but if the content is less than 0.80%, the desired effect by its action is not expected, or if contained more than 5.0%, further improvement of the effect is not expected, but also the hot processability is lowered, and hence the Mo content is defined within 0.80 to 5.0%. V acts to prevent increase of size of austenite particles and form fine carbides to improve the wear resistance and hardenability of the steel, but if its content is less than 0.2%, the desired effect by its action is not obtained, or if contained more than 0.5%, the processability is lowered, and hence the V content is defined within 0.1 to 0.5%. Meanwhile, the iron-based alloy to be used may also contain trace elements such as Ni as components aside from those defined above.

The entire hardness of the roll main body must be adjusted within $H_RC$ 52 to 56. This is because if the hardness of the entire roll section is less than $H_RC$ 52, a sufficient wear resistance is not maintained for a long term and the desired service life is not guaranteed, or if the roll main body hardness exceeds $H_RC$ 56, the toughness is insufficient, and large cracks leading to discarding of the roll are likely to occur.

Types of wear of the caliber roll for rolling include the following. First is the wear due to speed difference in rolling between the tube to be rolled and the caliber of the roll main body. It is advanced gradually in a relatively long time, but when the hardness is less than $H_RC$ 52, this wear is promoted in a short time, and the gloss of the caliber surface is lost. Typical wears leading to discarding of the roll are pitting wear and spalling shown in FIG. 5, and tube end mark shown in FIG. 6. What is particularly serious is pitting wear and spalling, which are caused in the caliber positions contacting with the portion corresponding to the major axis portion of the ellipse of the tube given rotating and feeding after rolled nearly in an elliptical form. More specifically, this area locally has a high surface pressure, and when the hardness of the caliber surface is low and strength is insufficient, pitting wear or peeling crack is induced. The tube end mark is a indentation of the roll surface due to contact with the tube end seam (corner of tube end) at the time of rolling, and in an extreme case the caliber surface is inducted irregularly in the circumferential direction, which adversely affects the surface properties and dimensional precision of the rolled tube.

On the other hand, the large crack, which is leaded to breakdown of the roll main body and is likely to occur when the roll main body hardness is set above $H_RC$ 56, means the shortness of the roll life. Generally, elevation of the roll hardness brings about a favorable effect for the wear resistance and fatigue strength improvement, but it induces cracks due to shortage of toughness, possibly leading to a shorter life in many cases. That is, the ordinary cold tube rolling (Pilger rolling) itself is an intermittent action, and excessive processing may occur due to abnormal feeding, or the mandrel may be broken and get into the rolling direction, and an impulsive overload due to such troubles are hard to avoid, and when the toughness is insufficient, a large crack is formed in such a case. Or to raise the hardness of the roll main body to such a high value as mentioned above, the heat treatment (tempering) temperature must be lowered, which may lead to residual stress or residual austenite, resulting in a large crack.

Accordingly, by adjusting the hardness of the roll main body in a range of $H_RC$ 52 to 56, the amount of abrasion becomes ½ or less of the conventional 0.8%C-1.7%Cr-0.3%Mo-0.1%V steel, and large cracks of the roll main body are almost completely eliminated. Still more, in this hardness region, tempering may be done above the secondary hardening temperature, so that the problems of residual stress and residual austenite may be solved almost thoroughly.

Furthermore, in the roll main body, the direction of metal flow is also extremely important. That is, if there is no nonmetallic inclusion or giant carbide at all in the material for composing the roll main body, the direction of metal flow is not so important, but it is practically impossible that nonmetallic inclusion and giant carbide are completely absent. These nonmetallic inclusion and giant carbides are rolled in the direction (direction of metal flow) in which the material is rolled by rolling, forging and other processing. If the nonmetallic inclusion rolled in the direction of metal flow is present in a form of extended in the roll radial direction on the bottom surface of the caliber 1*a* of the roll main body 1 or immediately beneath it as shown in FIG. 7 (*a*), a crack is initiated from it due to the tensile force (the tearing stress of the caliber bottom by the tube to be rolled) in the widthwise direction of the roll main body 1 when rolling. Therefore, if the inevitably existing nonmetallic inclusion and giant carbide are rolled, in order that the direction may be the widthwise direction (that is, the shaft central direction) of the roll main body 1 as shown in FIG. 7 (*b*), the metal flow must be positively controlled in the roll shaft central direction.

The manufacturing method of roll main body of caliber roll for rolling of the invention comprises a step of fabricating a columnar material of specified outside diameter by screwing down a billet made of iron-based alloy with the above chemical composition from the radial direction, a step of spheroidizing the fabricated columnar material by holding at 830° to 880° C. for three hours or more, a step of cutting out a disc in a specified width from the spheroidized material, and cutting and forming a shaft hole in the shaft central direction of the disc and a caliber in the outer circumference, and a step of hardening at 1000° to 1050° C., and tempering by cooling in air while holding at 540° to 590° C. for an hour or more. The reasons of defining the conditions for spheroidizing process, hardening process and tempering process are explained below.

The purpose of spheroidizing is to remove the processing strain, and if the heating temperature is held under 830° C. for less than three hours, the processing strain is not removed sufficiently, or heating in a temperature range exceeding 880° C. promotes production of giant carbides, which is not desired. If the hardening temperature is less than 1000° C., sufficient hardening effect is not obtained, or if the hardening temperature exceeds 1050° C., the texture becomes coarse, and the toughness is lowered. Tempering is the heat treatment for adjusting the hardness to $H_RC$ 52 to 56, and if the tempering temperature is out of the range of 540° to 560° C., or if the tempering time is less than an hour, the desired hardness is not obtained.

The above and further objects and features of the invention will more fully be apparent from the following detailed description with accompanying drawings.

DESCRIPTION OF THE PREFERRED EMBODIMENTS

Some of the embodiments of the invention are described in detail below.

First the manufacturing method of the roll main body of a caliber roll for rolling is explained.

In manufacturing the roll main body of a caliber roll for rolling relating to the invention, first is prepared a billet (ingot) of an iron-based alloy steel including, by weight, C: 0.75 to 1.75%, Si: 3.0% or less, Mn: 2.0% or less, P: 0.030% or less, S: 0.030% or less, Cr: 5.0 to 13.00%, Mo: 0.80 to 5.0%, and V: 0.1 to 0.5%. This billet may be obtained by melting the steel having the above chemical composition in, for example, an electric furnace, but, if possible, it is preferable to use a columnar ingot by melting in an electric furnace to obtain a columnar piece as an electrode, and further processing by electroslag remelting (ESR). That is, by ESR process, segregation is eliminated as far as possible, and the size of giant carbide is reduced, and the number thereof is also decreased, and moreover nonmetallic inclusions decrease and the fatigue strength is raised, so that the crack resistance is further enhanced.

Figure 8:
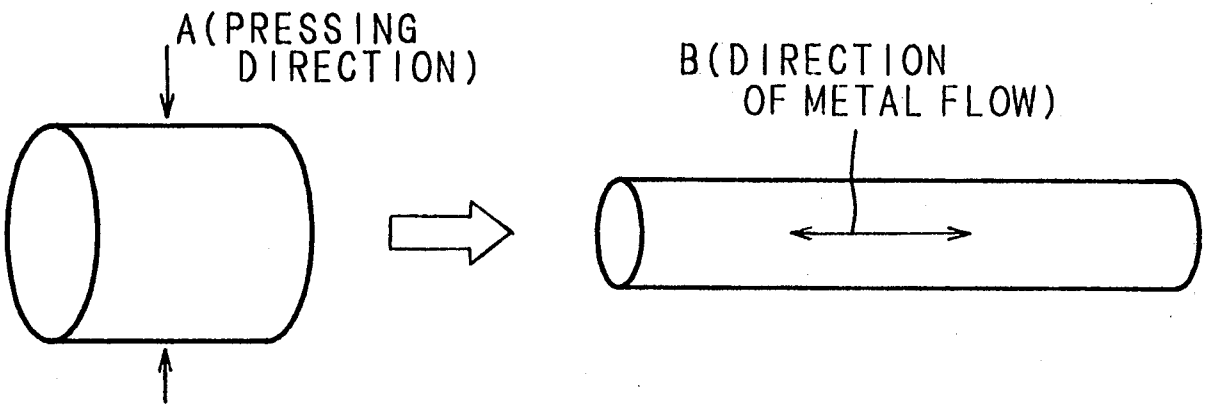
FIG. 8 is a conceptual diagram explaining a processing method of a billet relating to the invention.

In succession, this billet is rolled in the axial direction by applying pressure from the radial direction (the direction of arrow A in FIG. 8) by rolling or forging, thereby obtaining a columnar material. As a result, the direction of metal flow is the shaft central direction as indicated by arrow B in FIG. 8. Thus, the metal flow in the roll shaft central direction is realized by screwing down the casting material from the radial direction by rolling or forging with a sufficient reduction into a columnar shape, when obtaining a columnar material for fabricating the roll main body. At this time, the elongation ratio (the sectional area before processing/sectional area after processing) should be preferably four times or more in order to produce a sufficient metal flow.

Sequentially, such columnar material is cut in slices, and a disc-shaped roll material is obtained, but prior to this the columnar material is spheroidized by holding at 830° to 880° C. for three hours or more and cooling in furnace. The purpose of this spheroidizing is to remove processing strains, and if the holding time of the heating temperature of below 830° C. is less than three hours, the processing strains are not removed sufficiently, or heating in a temperature range exceeding 880° C. promotes formation of giant carbides, which is not preferable. In thus prepared material, the direction of the metal flow is the widthwise direction (the shaft central direction), thereby obtaining, needless to say, the anisotropy resistant to cracks.

Meanwhile, as the technique for preparing a disc material for manufacturing one roll main body, for example, the columnar ingot is directly cut in slices, and obtained short columnar ingots are forged and screwed down in the shaft central direction to widen the diameter. In this case, however, the metal flow direction is the radial direction of the disc material, and therefore the nonmetallic inclusions and giant carbides are rolled in the radial direction, and the roll main body manufactured therefrom is likely to be cracked by the tensile force applied to the caliber bottom at the time of rolling, which is not preferable.

Figure 9:
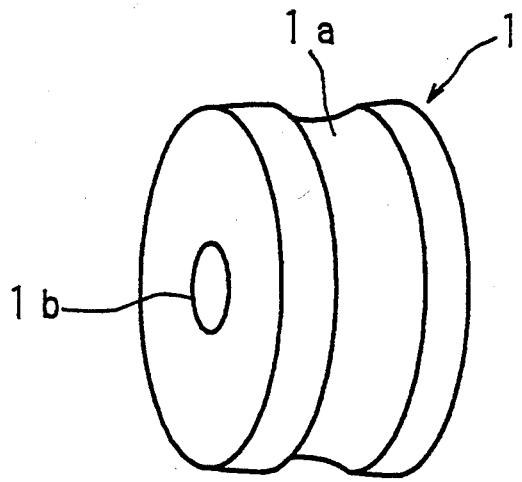
FIG. 9 is a schematic diagram showing the entire shape of a roll main body of caliber roll for rolling.

Next, in the disc material, as shown in FIG. 9, a tapered caliber 1*a* is cut and formed, and the lateral face and circumferential face are aligned by cutting. Furthermore, a shaft hole 1*b* for shrinkage-fitting (or cold-fitting) to the roll shaft is pierced in its shaft central direction, thereby completing the roll main body 1.

Thus prepared roll main body 1 is then treated by hardening and tempering.

The hardening process is executed in order to transform the material texture into martensite texture to obtain high hardness, and after heating to 1000° to 1050° C., the material is cooled in air or cooled in oil. As a result, the hardness of about $H_RC$ 63 is obtained. At this step, if the hardening temperature is less than 1000° C., a sufficient hardening effect is not achieved, or if the hardening temperature exceeds 1080° C., the texture is made coarse, and the toughness is lowered.

Tempering is a heat treatment for adjusting the hardness to $H_RC$ 52 to 56, and it is executed in the condition of holding at 540° to 590° C. for an hour or more and cooling in air. If the tempering temperature is out of the above range, or the tempering time is less than an hour, adjustment to the desired hardness is unstable. Here, the tempering temperature is to select a proper temperature in this temperature range depending on the steel grade and hardening condition to adjust the hardness to $H_RC$ 52 to 56, and when the SKD11 steel is hardened at 103° C. and cooled in air, it is desired to temper at 540° to 560° C., or when the SKD11 modified steel is hardened at 1030° C. and cooled in air, at 560° to 580° C., or when hardened at 1030° C. and cooled in oil, at 570° to 590° C.

Figure 1:
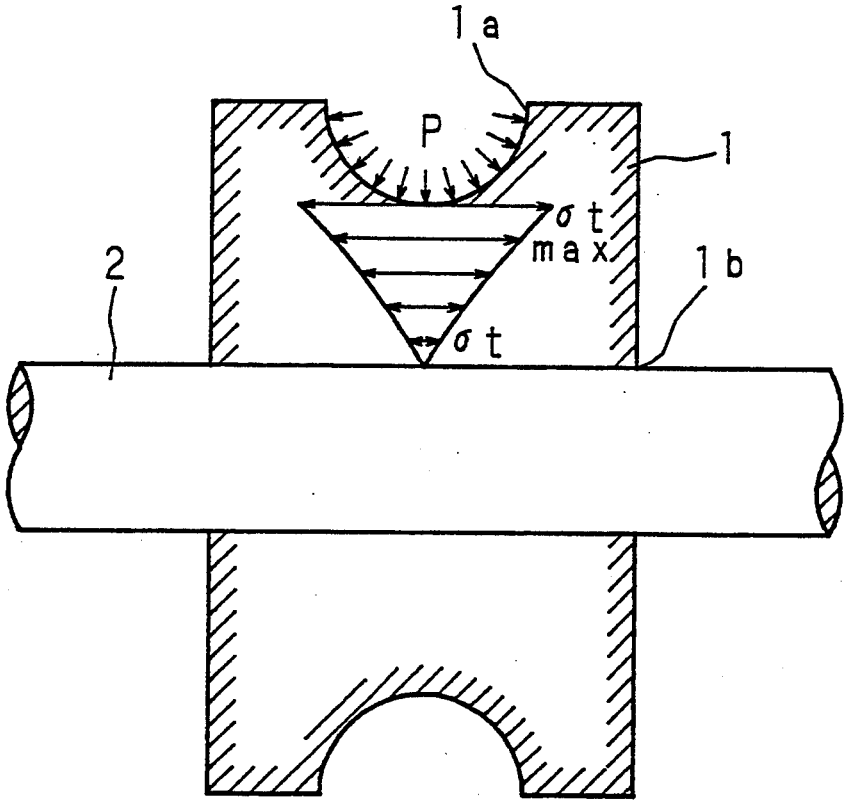
Fig. 1 Prior Art
FIG. 1 is an explanatory diagram showing the distribution of tensile stress $\sigma_T$ acting on the caliber bottom surface of a caliber roll for rolling by surface pressure P.
Figure 2:
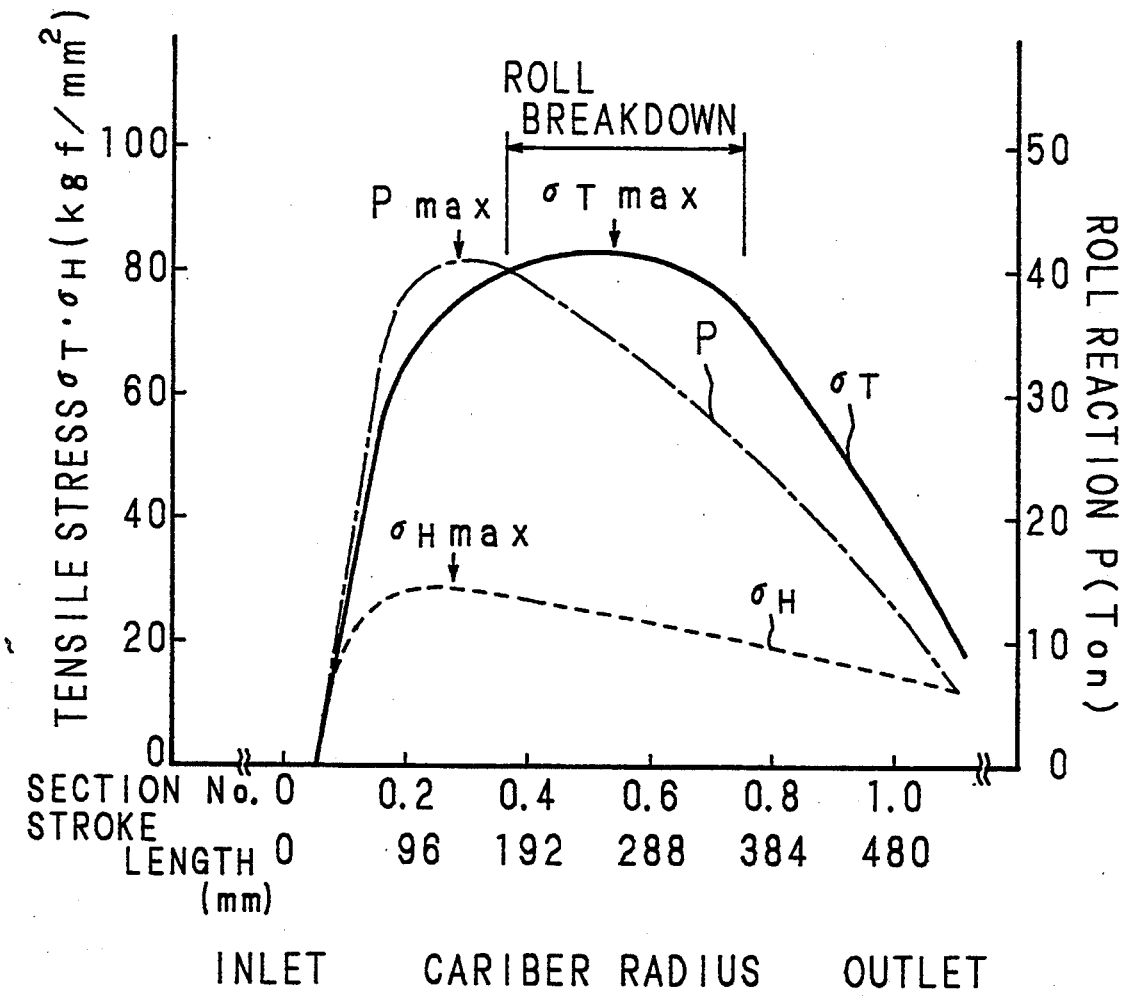
Fig. 2 Prior Art
FIG. 2 is a diagram showing an example of roll peripheral distribution of vertical components of surface pressure applied on a caliber roll for rolling and tensile stress of caliber caused by it.
Figure 3:
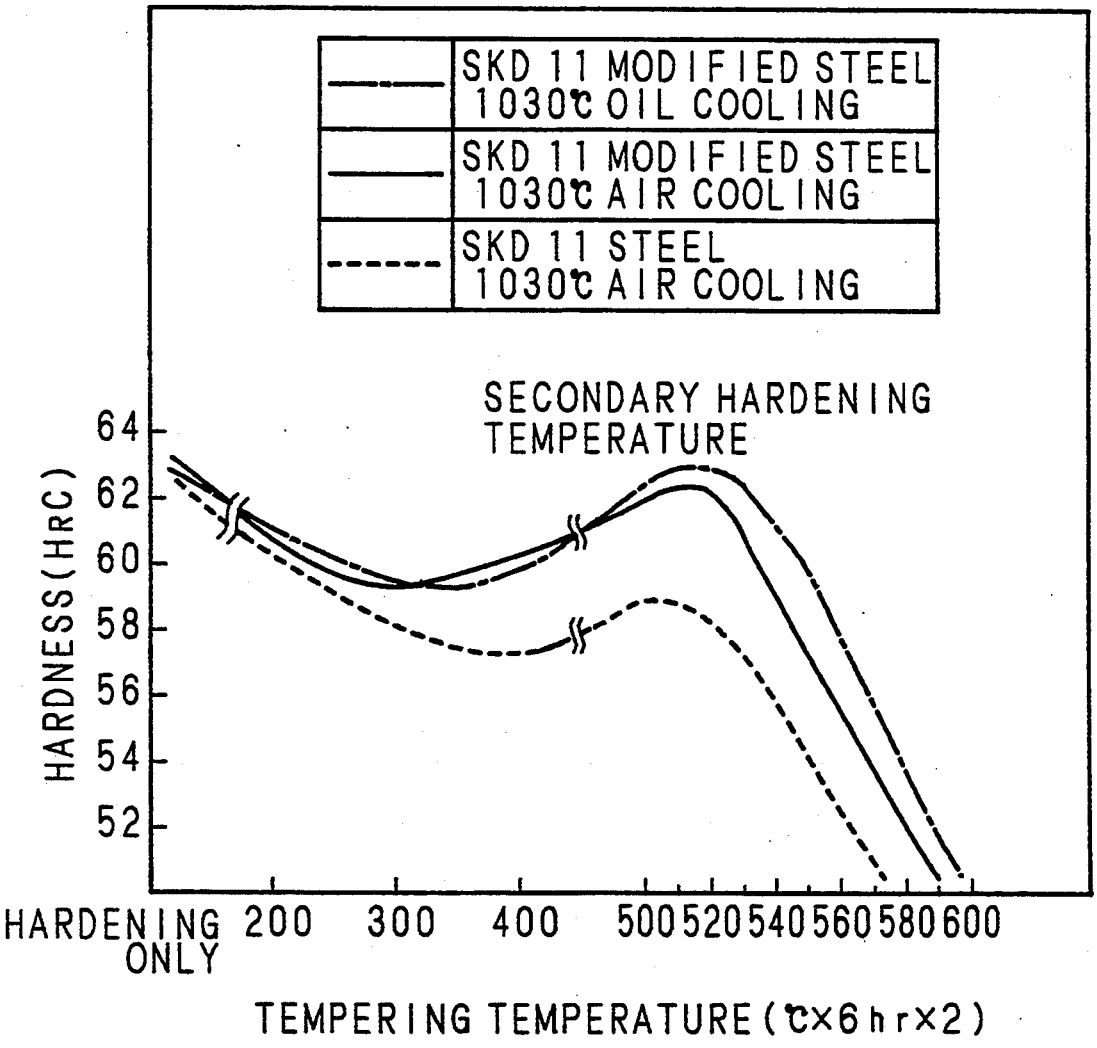
Fig. 3 Prior Art
FIG. 3 is a diagram showing a tempering temperature curve of high carbon high alloy tool steel.
Figure 4:
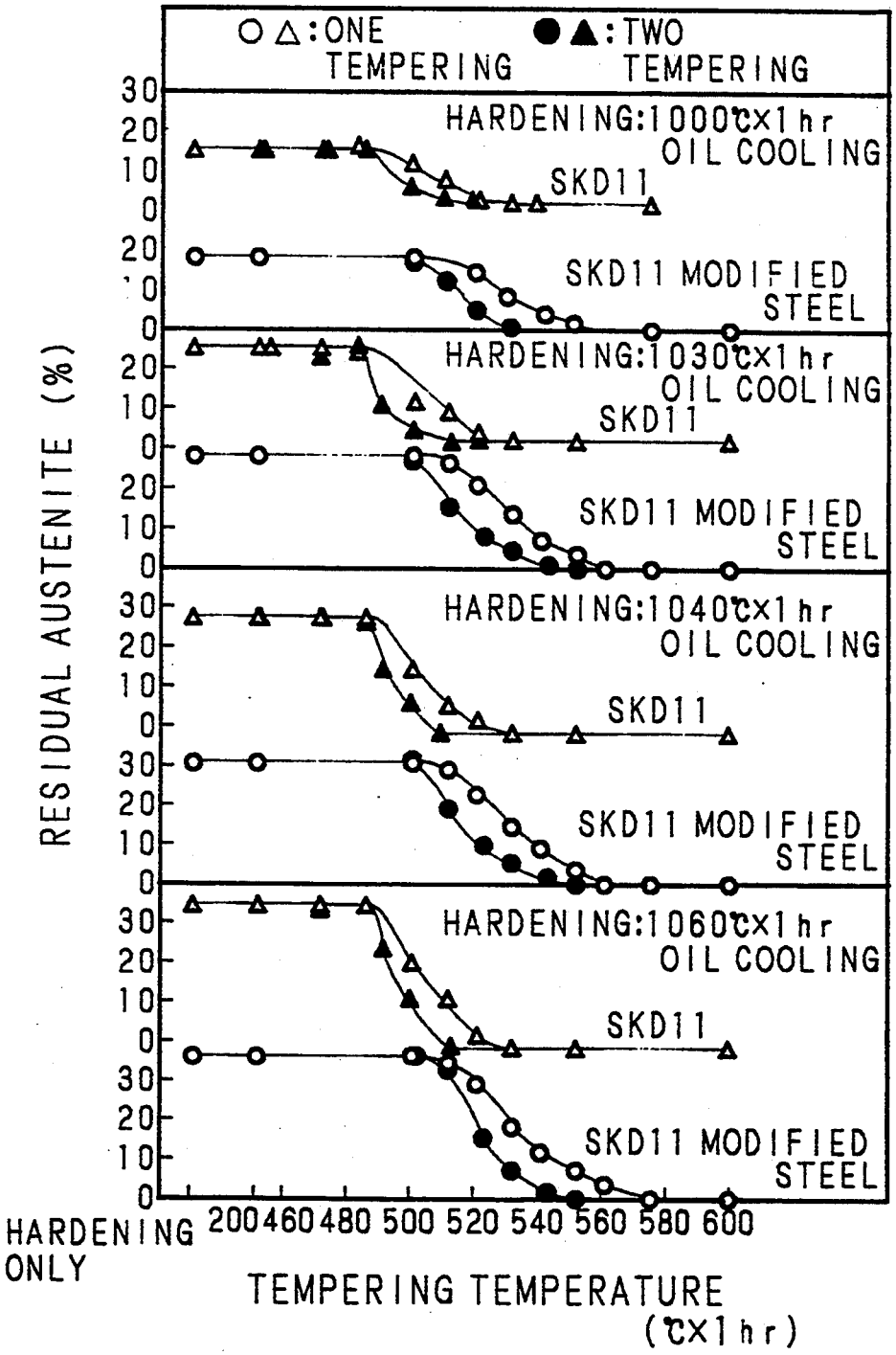
FIG. 4 is a graph showing the relation of tempering temperature, number of times of tempering and residual austenite amount of high carbon high alloy tool steel.
Figure 5:
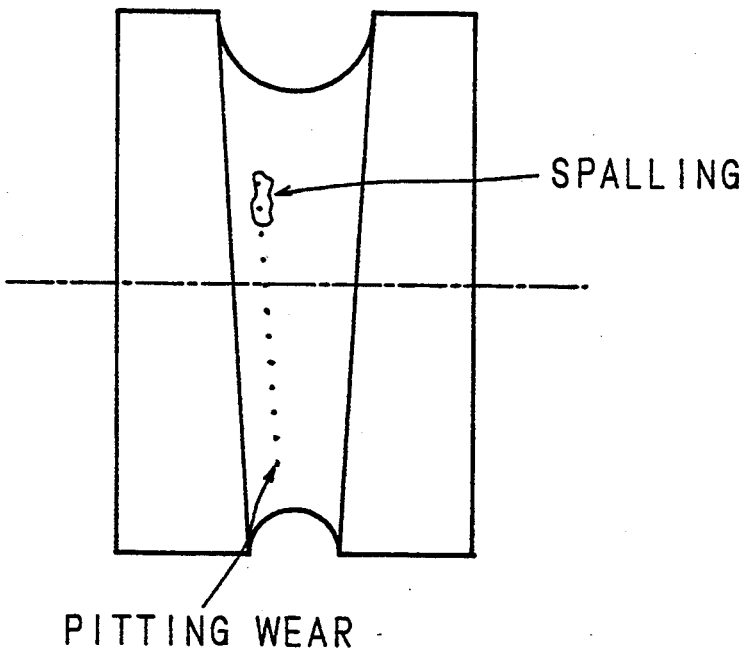
FIG. 5 is a conceptual diagram explaining the situation of pitting wear and spalling of a caliber roll for rolling.
Figure 6:
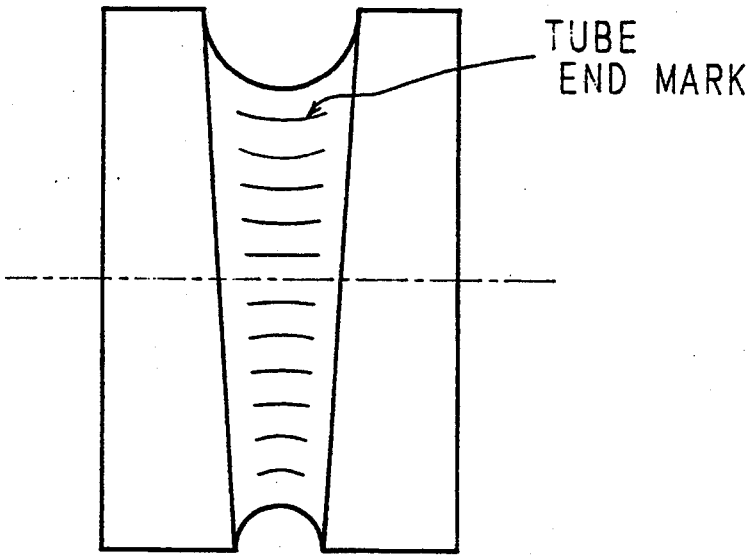
FIG. 6 is a conceptual diagram explaining the situation of tube end mark occurrence of a caliber roll for rolling.
Figure 7A:
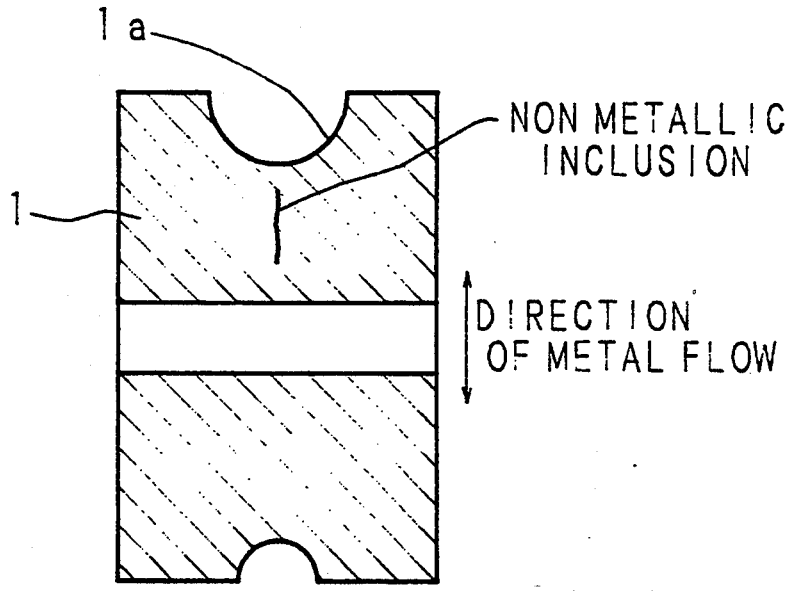
FIG. 7 is a conceptual diagram explaining the situation of metal flow direction and nonmetallic inclusion of a caliber roll for rolling.
Figure 7B:
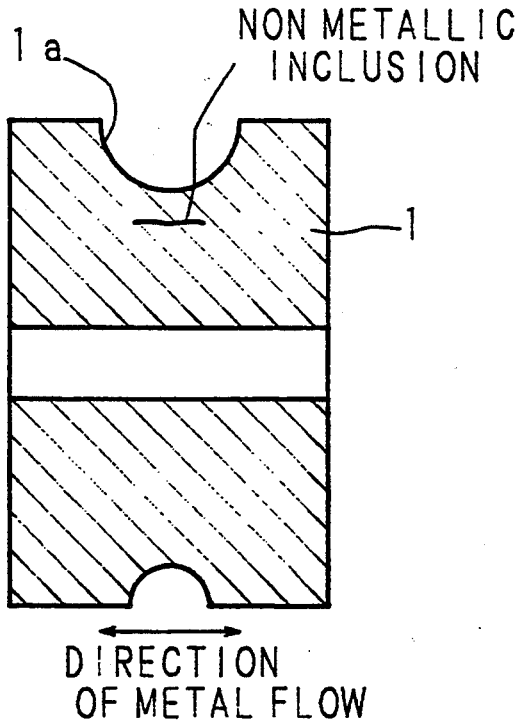

As known, meanwhile, from the tempering temperature curve in FIG. 3, once the hardness is determined, the tempering temperature is decided accordingly, and in the tempering of the invention, this temperature is above the secondary hardening temperature. Besides, since the tempering temperature is set at a high temperature above the secondary hardening temperature, the residual austenite is decomposed and is almost completely lost, and the tensile residual stress is easily released. Incidentally it is desired to temper plural times. That is, as clear from FIG. 4 showing the relation of the tempering temperature, number of times of tempering and residual austenite, it is intended to decrease the residual austenite furthermore.

The roll main body 1 after hardening and tempering is entirely ground and finished to correct the shape strain by hardening and tempering, adjust the roughness of caliber, and achieve the dimensional precision, and a product is obtained.

Explained below is the shape of the roll main body of a caliber roll for rolling of the invention and the roll shaft to be inserted therein, for producing a compressive stress in the bottom of the caliber of the roll main body, in detail.

Figure 10:
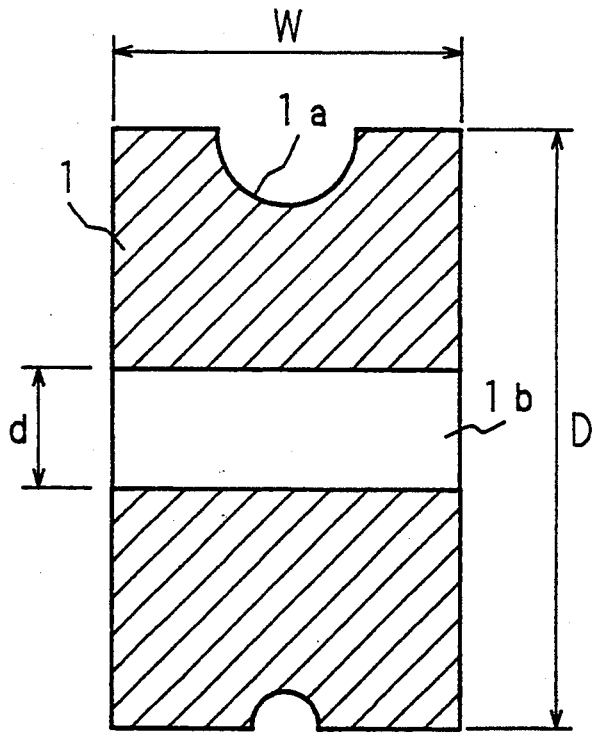
FIG. 10 is a schematic diagram showing an example of a shape of the roll main body of caliber roll for rolling.
Figure 11:
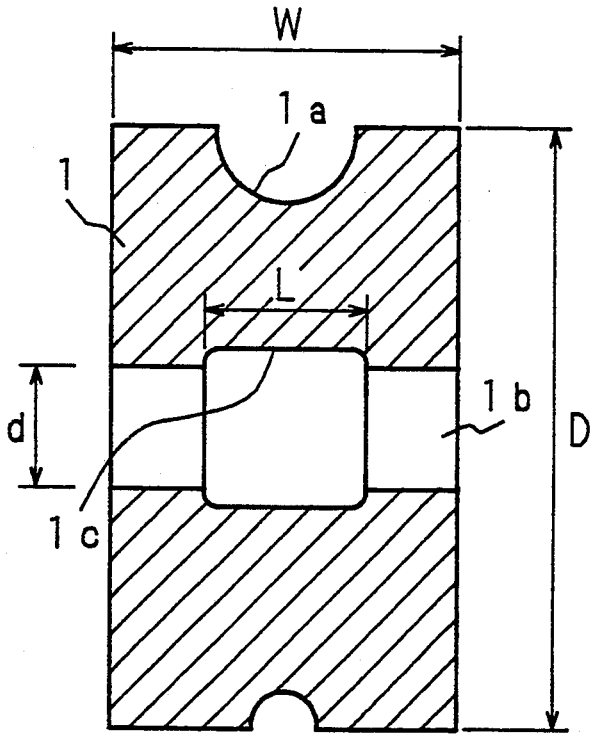
FIG. 11 is a schematic diagram showing an example of another shape of the roll main body of caliber roll for rolling.

FIG. 10 and FIG. 11 are schematic diagrams showing the types of roll main body 1. The example shown in FIG. 10 is the roll main body 1 of the type having a specified caliber 1*a* formed on the outer circumference and a shaft hole 1*b* pierced in its shaft central direction. The example shown in FIG. 11 is the roll main body 1 of the type having a specified caliber 1*a* formed on the outer circumference and a shaft hole 1*b* pierced in its shaft central direction, and further having a recess gap 1*c* in the middle of the shaft hole 1*b* being contiguous thereto. In FIGS. 10, 11, W, D, d respectively denote the width of the roll main body 1, the outside diameter of the roll main body 1, and the inside diameter of the roll main body 1 (the diameter of shaft hole 1*b*), and L in FIG. 11 represents the length of the recess gap 1*c* in the widthwise direction.

FIGS. 12 to 15 are schematic diagrams showing examples of roll main body 1 and roll shaft 2 of the caliber roll for rolling of the invention, and a part of the roll main body 1 is omitted. In each example, a shrinkage-fitting allowance (or cold-fitting allowance) 1*d* is disposed at the inner circumferential side of the roll main body 1, and this shrinkage-fitting allowance (or cold-fitting allowance) 1*d* is large at both sides of the roll main body 1 in the width direction, and gradually decreases toward the central part. Each embodiment is individually described below.

Figure 12:
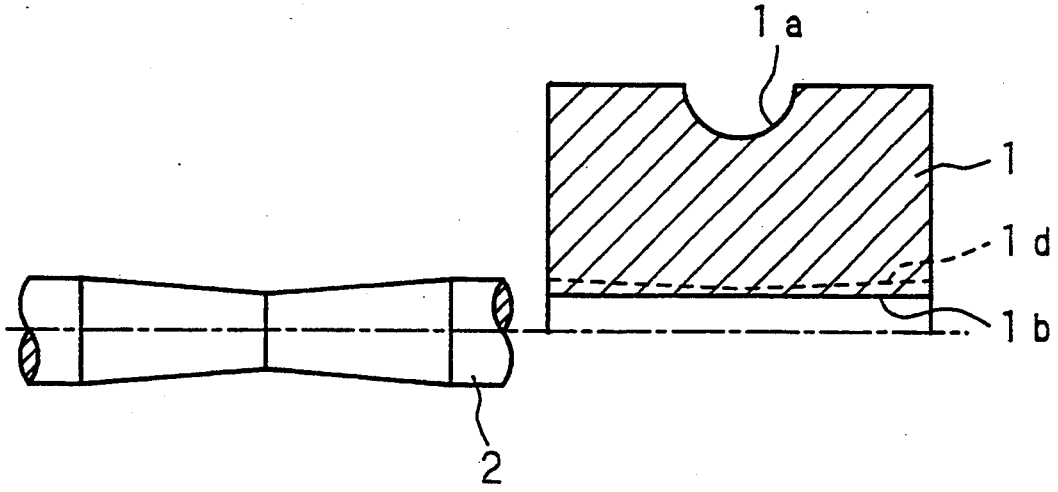
FIG. 12 is a schematic diagram showing an embodiment of a caliber roll for rolling of the invention.

FIG. 12 relates to a caliber roll for rolling including a roll main body 1 having a caliber 1*a* and a shaft hole 1*b* of uniform diameter and provided with a shrinkage-fitting allowance (or cold-fitting allowance) 1*d*, and a roll shaft 2 of which diameter gradually decreases in a taper from both ends toward the central part. In the case of this caliber roll for rolling, when the roll main body 1 and roll shaft 2 are shrinkage-fitted (or cold-fitted), a compressive stress is built up in the bottom of the caliber 1*a* of the roll main body 1 due to the taper action of the roll shaft 2.

Figure 13:
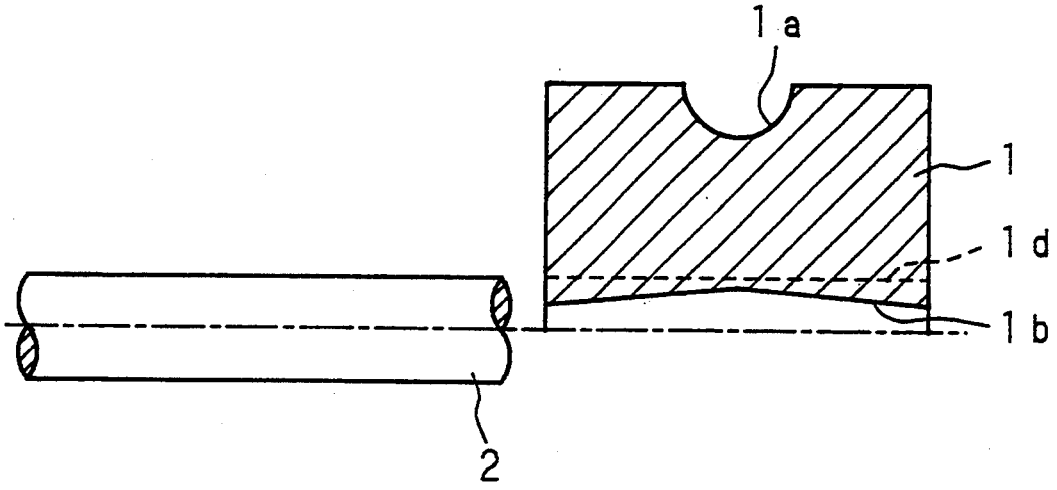
FIG. 13 is a schematic diagram showing another embodiment of a caliber roll for rolling of the invention.

FIG. 13 shows a caliber roll for rolling including a roll main body 1 having a caliber 1*a* and a shaft hole 1*b* of which diameter increases in a taper toward the central part and provided with a shrinkage-fitting allowance (or cold-fitting allowance) 1*d*, and a roll shaft 2 of uniform diameter. In the case of this caliber roll for rolling, too, by shrinkage-fitting (or cold-fitting) of the two, a compressive stress is generated in the bottom of the caliber 1*a* same as in the embodiment shown in FIG. 12.

Figure 14:
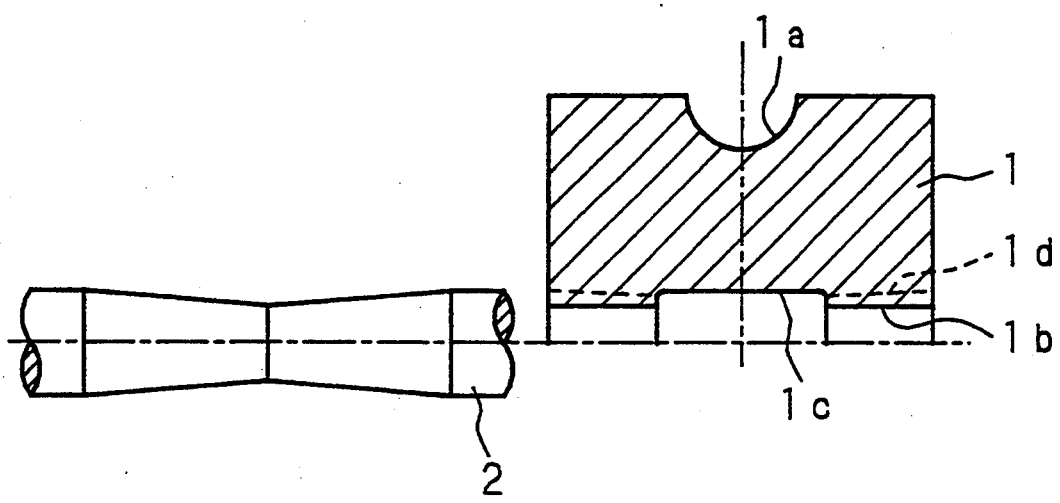
FIG. 14 is a schematic diagram showing a further embodiment of a caliber roll for rolling of the invention.

FIG. 14 shows a caliber roll for rolling including a roll main body 1 having a caliber 1*a* and a shaft hole 1*b* of uniform diameter, and provided with a recess gap 1*c* in the middle part of the shaft hole 1*b* and a shrinkage-fitting allowance (or cold-fitting allowance) 1*d*, and a roll shaft 2 of which diameter decreases gradually in a taper from both ends toward the central part. In this case, a compressive stress due to shrinkage-fitting allowance (or cold-fitting allowance) 1*d*, and a compressive stress generated due to deflection of the roll by recess gap 1*c* are produced in the bottom of the caliber 1*a*.

Figure 15:
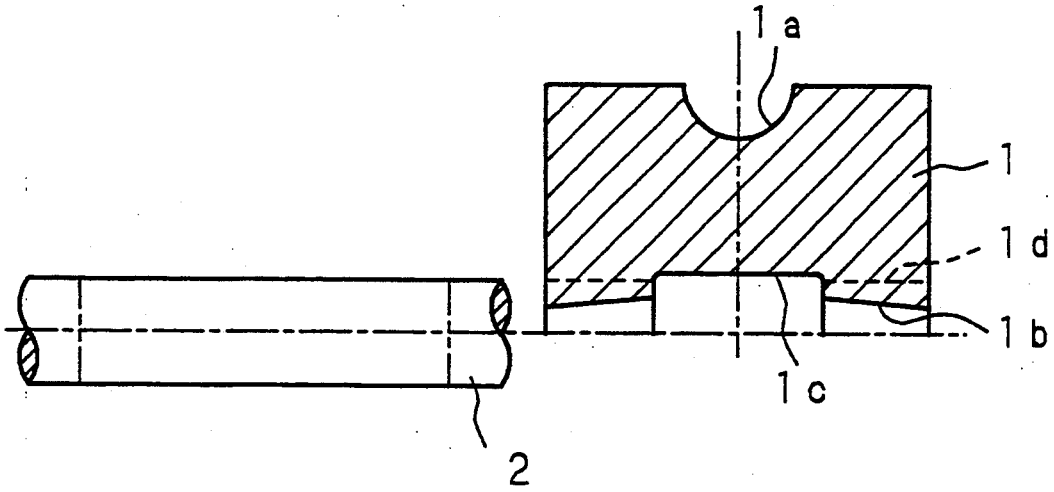
FIG. 15 is a schematic diagram showing a further different embodiment of a caliber roll for rolling of the invention.

FIG. 15 shows a caliber roll for rolling including a roll main body 1 having a caliber 1*a* and a shaft hole 1*b* of which diameter increases in a taper toward the central part, and provided with a recess gap 1*c* in the middle part of the shaft hole 1*b* and a shrinkage-fitting allowance (or cold-fitting allowance) 1*d*, and a roll shaft 2 of uniform diameter. In this case, too, same as the embodiment shown in FIG. 14, both compressive force due to shrinkage-fitting allowance (or cold-fitting allowance) 1*d* and compressive stress due to deflection of roll by recess gap 1*c* are generated in the bottom of the caliber 1*a*.

Figure 16:
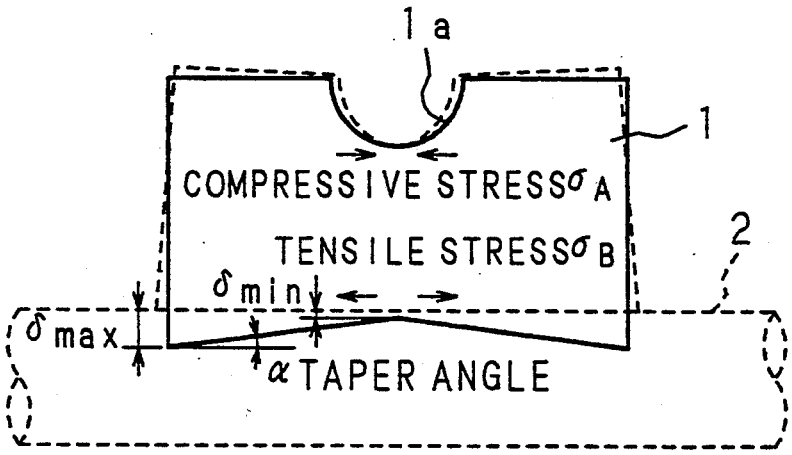
FIG. 16 is an explanatory diagram showing a generation mechanism of compressive stress at the time of shrinkage-fitting (or cold-fitting) of roll main body and roll shaft.
Figure 17:
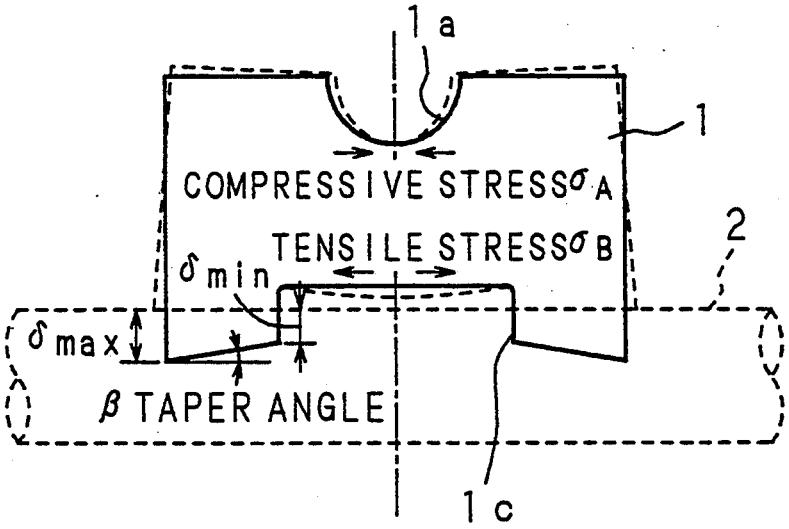
FIG. 17 is an explanatory diagram showing another generation mechanism of compressive stress at the time of shrinkage-fitting (or cold-fitting) of roll main body and roll shaft.

Here is explained the mechanism of generation of compressive stress due to shrinkage-fitting (or cold-fitting) in the case of taper processing of the internal circumference of the roll main body 1. As shown in FIGS. 16, 17, the shrinkage-fitting allowance (or cold-fitting allowance) has the minimum value $\delta_{min}$ in the center of the roll main body 1 in the widthwise direction, and the maximum value $\delta_{max}$ at both ends, and when shrinkage-fitting (cold-fitting) is executed, the roll main body 1 is deformed as indicated by broken line, and a compressive stress is applied to the bottom of the caliber 1*a*.

The method of determining the shrinkage-fitting allowance (or cold-fitting allowance) is described below.

1. Mean shrinkage-fitting allowance (or cold-fitting allowance) $\delta_{mean}$

In the case of conventional caliber roll for Pilger rolling (without taper processing and recess gap in the roll main body), in order to prevent slipping of the roll main body and roll shaft, the shrinkage-fitting force (or cold-fitting force) is set as design specification, and the shrinkage-fitting allowance (or cold-fitting allowance) is predetermined to maintain this shrinkage-fitting force (or cold-fitting force). Therefore, if the shrinkage-fitting allowance (or cold-fitting allowance) is, for example as shown in FIG. 16, $\delta_{max}$ at both sides of the roll main body 1, and $\delta_{min}$ in the central part, the mean shrinkage-fitting allowance (or cold-fitting allowance) $\delta_{mean}=(\delta_{max}+\delta_{min})/2$ is so set as to be greater than the predetermined shrinkage-fitting allowance (or cold-fitting allowance).

2. Maximum shrinkage-fitting allowance (or cold-fitting allowance) $\delta_{max}$ The roll main body and roll shaft are made of, for example, JIS-SKD11 steel, and the strength is adjusted by final hardening and tempering, and the tempering temperature is about 250° C. at the lowest although variable with the grade of steel. At the time of shrinkage-fitting, meanwhile, the roll main body heating temperature must not be above the tempering temperature, and to prevent softening of the surface of the roll main body, it is desired to set at a temperature of 200° C. or less. Therefore, the maximum shrinkage-fitting allowance (or cold-fitting allowance) $\delta_{max}$ is based on the thermal expansion allowance by heating of the roll main body (or shrinkage allowance by cooling of the roll shaft), and is determined in consideration of the working efficiency and other conditions.

3. Minimum shrinkage-fitting allowance (or cold-fitting allowance) $\delta_{min}$ Once the mean shrinkage-fitting allowance (or cold-fitting allowance) $\delta_{mean}$ and maximum shrinkage-fitting allowance (or cold-fitting allowance) $\delta_{max}$ are determined, $\delta_{min}$ is calculated in the following formula.

$$\delta_{min}=2\delta_{mean}-\delta_{max}$$

By thus determining $\delta_{max}$, $\delta_{min}$, in order to achieve $\delta_{max}$ at both ends of the roll main body and $\delta_{min}$ in the central part, the inner circumference of the roll main body 1 or the circumference of the roll shaft 2 is tapered. Or as shown in FIG. 17, in the case of a caliber roll for rolling having a recess gap 1*c* in the middle of the roll main body 1, since the recess gap 1*c* is not responsible for maintaining the shrinkage-fitting force (or cold-fitting force) at the time of shrinkage-fitting (or cold-fitting), the mean shrinkage-fitting allowance (or cold-fitting allowance) $\delta_{mean}$ at both sides is taken sufficiently depending on the width of the recess gap 1*c*, and the maximum shrinkage-fitting allowance (or cold-fitting allowance) $\delta_{max}$ and minimum shrinkage-fitting allowance (or cold-fitting allowance) $\delta_{min}$ are determined.

When the shrinkage-fitting allowance (or cold-fitting allowance) is determined in this way, the flange part of the roll main body 1 is tilted in the direction of the caliber 1*a* depending on the taper angle ($\alpha$ in FIG. 16, $\beta$ in FIG. 17) of the shrinkage-fitting allowance (or cold-fitting allowance), and a compressive stress $\sigma_A$ corresponding to the taper angle $\alpha$, $\beta$ acts on the bottom of the caliber 1*a*. Incidentally, as a result of thus determining the taper angle of the shrinkage-fitting allowance (or cold-fitting allowance), the compressive stress $\sigma_A$ acting on the bottom of the caliber 1*a* becomes large, and accordingly the tensile stress $\sigma_B$ acting on the middle of the inner circumference of the roll main body 1 also becomes large. Consequently, the value of subtracting the preliminarily applied compressive stress $\sigma_A$ from the maximum tensile stress $\sigma_{Tmax}$ acting on the bottom surface of the caliber 1*a* during rolling may be sometimes smaller than the tensile stress $\sigma_B$ acting on the middle of the inner circumference of the roll main body 1. In such state, although roll crack from the bottom of the caliber 1*a* may be prevented, since the tensile stress $\sigma_B$ is great, roll crack may be initiated from the middle of the inner side of the roll main body 1. At this time, the taper angle of the shrinkage-fitting allowance (or cold-fitting allowance) is reduced so that the value of subtracting $\sigma_A$ from $\sigma_{Tmax}$ may be about $\sigma_B$. Or in the case of a caliber roll for rolling having a recess gap 1*c* contiguous to the shaft hole 1*b*, as mentioned above, a compressive stress acts on the bottom of the caliber 1*a* by deflection of the roll main body 1 due to the recess gap 1*c*. If the result of subtracting the sum of this compressive stress and the compressive stress caused by the taper angle of the shrinkage-fitting allowance (or cold-fitting allowance) from $\sigma_{Tmax}$ is smaller than $\sigma_B$, the taper angle should be reduced.

Figure 18:
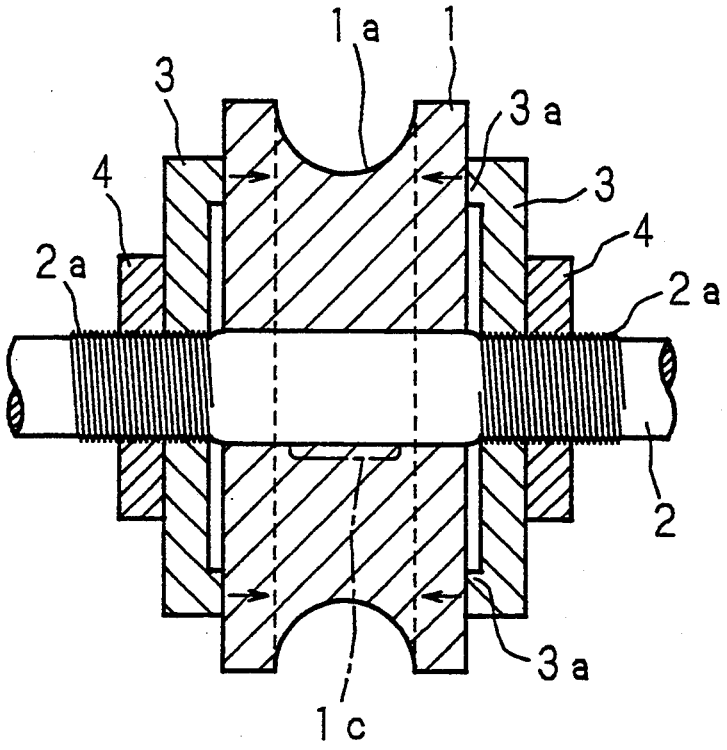
FIG. 18 is a schematic diagram showing an embodiment of generating compressive stress by a pressure ring.
Figure 19:
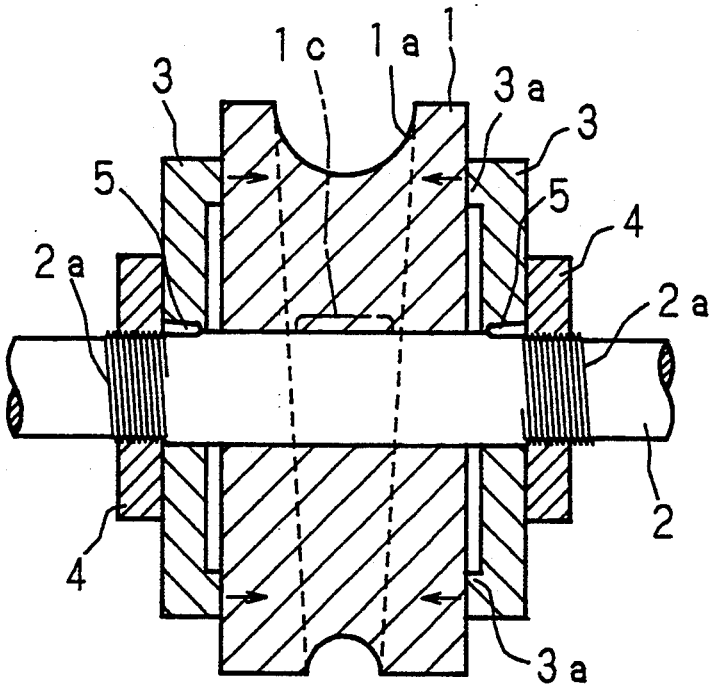
FIG. 19 is a schematic diagram showing another embodiment of generating compressive stress by a pressure ring.

In other embodiments explained below, it is intended to apply a compressive stress to the bottom of the caliber 1*a* of the roll main body 1 by a pressing jig. FIGS. 18, 19 are schematic diagrams of such embodiments of caliber roll for rolling. FIG. 18 relates to an example of using a roll main body 1 having a caliber 1*a* in a same shape in the peripheral direction, and FIG. 19 shows an embodiment of using a roll main body 1 having a caliber 1*a* in a taper in the peripheral direction.

FIG. 18 shows a caliber roll for rolling including a roll main body 1 having a caliber 1*a* in a same shape in the peripheral direction, and provided with a recess gap 1*c*, and a roll shaft 2 having male threads 2*a* formed at both ends. A round pressure ring 3 having a pressure head 3*a* corresponding to the bottom of the caliber 1*a* in the peripheral direction is screwed into the male threads 2*a* of the roll shaft 2 together with a locknut 4, and a compressive force is applied to the bottom of the caliber 1*a*.

FIG. 19 shows a caliber roll for rolling including a roll main body 1 having a caliber 1*a* in a taper in the peripheral direction, and provided with a recess gap 1*c*, and a roll shaft 2 having male threads 2*a* formed at both ends. A non-round pressure ring 3 having a pressure head 3*a* corresponding to the bottom of the caliber 1*a* in the peripheral direction is externally fitted to the roll shaft 2, and is locked with a sink key 5 for correspondence of the pressure head 3*a* and the bottom of the caliber 1*a*, and a locknut 4 is screwed into the male threads 2*a* of the roll shaft 2, so that a compressive force is applied to the bottom of the caliber 1*a*.

In the embodiments shown in FIGS. 18, 19, the recess gap 1*c* is provided, but it is not always necessary.

Actual manufactured examples of the caliber roll for rolling of the invention and their performances are described specifically below.

First, in an electric furnace, steels of various chemical compositions are melted, and columnar ingots of 800 mmϕ in outside diameter are obtained. Some of the samples are prepared in columnar ingots in the same size by further electroslag remelting. The columnar ingots are forced by screwing down only in the radial direction, and columnar materials of 310 mmϕ in outside diameter are obtained, and the obtained columnar materials are spheroidized in various conditions, and cut in slices, and disc materials of 140 mm in width are obtained. In succession, a taper caliber is formed in the disk material by cutting and processing, and the lateral surface and circumferential surface are properly treated, and a shaft hole is pierced in the shaft central direction in order to shrinkage-fit the roll shaft. After hardening and tempering in various conditions, the whole surface is ground, and a roll main body with the outside diameter of 300 mmϕ and width of 130 mm is obtained. Needless to say, the metal flow of the roll main body manufactured is in the shaft central direction.

In this manufacturing process, three iron-based alloy steels having the chemical compositions as shown in Table 1 are used as the material steels. Steel grades A and B in Table 1 are the desired steels of the invention, and in particular steel grade B is the SKD11 modified steel, while steel grade C in Table 1 is a reference steel.

TABLE 1

| Steel grade | | Chemical composition | | | | | | | | | | |
|---|---|---|---|---|---|---|---|---|---|---|---|---|
| | | C | Si | Mn | P | S | Cr | Mo | V | N | O | Fe and impurities |
| Invention steel | A | 1.60 | 0.31 | 0.40 | 0.02 | 0.01 | 12.0 | 0.9 | 0.26 | 0.02 | 0.004 | Balance |
| | B | 0.95 | 1.04 | 0.41 | 0.01 | 0.001 | 8.4 | 2.0 | 0.24 | 0.01 | 0.002 | Balance |
| Reference steel | C | 0.80 | 0.28 | 0.37 | 0.02 | 0.01 | 1.7 | 0.3 | 0.11 | 0.02 | 0.004 | Balance |

Using the caliber roll for rolling having thus manufactured roll main body, rolling process is conducted in the rolling conditions as shown in Table 2.

TABLE 2

| | | | |
|---|---|---|---|
| Material of roll main body | JIS SKD11 modified steel (1.0% C-1.0% Si-0.4% Mn-8.5% Cr-12.0% Mo-0.2%) | | |
| Roll main body type (FIGS. 10, 11) | FIG. 10 type: | W = 130 mm<br>d = ϕ170 mm | D = ϕ300 mm |
| | FIG. 11 type: | W = 130 mm<br>d = ϕ170 mm | D = ϕ300 mm<br>L = 54 mm |
| Rolling schedule | 38ϕ × 5t → 19ϕ × 1.65t (Rd = 83%) | | |
| Material of object to be rolled and feed rate | Material: SUS 304<br>Feed rate: 7 mm/stroke | | |

The material of the roll main body in Table 2 corresponds to steel grade B in Table 1. The numerical values of the roll main body type in Table 2 represent the dimensions in FIGS. 10, 11. The results of rolling process are summarized in Tables 3, 4.

TABLE 3

Figure 20:
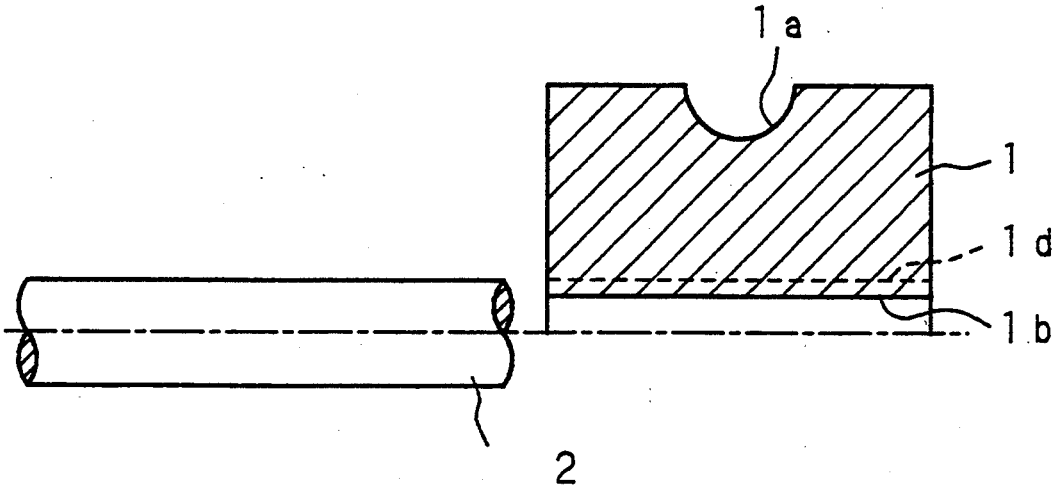
FIG. 20 is a schematic diagram showing a reference example to a caliber roll for rolling of the invention.
Figure 21:
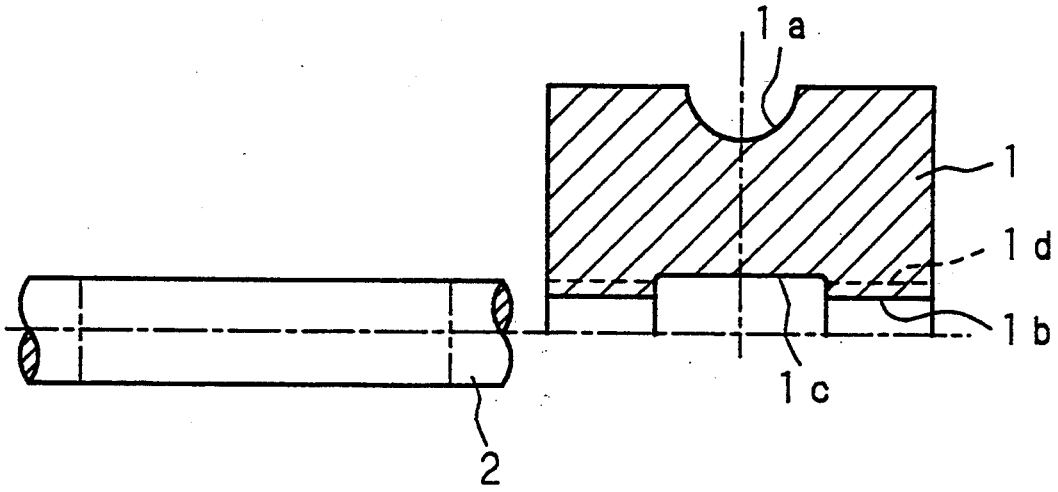
FIG. 21 is a schematic diagram showing another reference example to a caliber roll for rolling of the invention.

| Test No. | Roll main body type | Caliber Roll type | Shrinkage-fitting allowance (mm) δ max | δ min | Max. tensile stress caused during rolling (kgf/mm²) | Compressive stress caused by recess deflection (kgf/mm²) | Compressive stress caused by taper shrinkage-fitting or pressing jig (kgf/mm²) | Rolling length until discarding (× 10³ m) | Cause of discarding |
|---|---|---|---|---|---|---|---|---|---|
| 1 Reference | FIG. 10 | FIG. 20 | 0.110 | 0.110 | 81 | 0 | 0 | 30–40 | Crack |
| 2 Invention | FIG. 10 | FIG. 12 | 0.160 | 0.060 | 81 | 0 | 12 | 100–120 | Crack |
| 3 Reference | FIG. 11 | FIG. 21 | 0.120 | 0.120 | 81 | 8 | 0 | 60–75 | Crack |
| 4 Invention | FIG. 11 | FIG. 14 | 0.160 | 0.080 | 81 | 8 | 16 | Even at 200 or higher, no crack is formed, being in normal state. | |
| 5 Invention | FIG. 10 | FIG. 19 | 0.110 | 0.110 | 81 | 0 | 12 | 100–120 | Crack |

TABLE 4

| Test No. | Roll main body type | Caliber Roll type | Shrinkage-fitting allowance (mm) δ max | δ min | Max. tensile stress caused during rolling (kgf/mm²) | Compressive stress caused by recess deflection (kgf/mm²) | Compressive stress caused by taper shrinkage-fitting or pressing jig (kgf/mm²) | Rolling length until discarding (× 10³ m) | Cause of discarding |
|---|---|---|---|---|---|---|---|---|---|
| 1 Reference | FIG. 10 | FIG. 20 | 0.110 | 0.110 | 81 | 0 | 0 | 100–120 | Crack |
| 2 Invention | FIG. 10 | FIG. 12 | 0.160 | 0.060 | 81 | 0 | 12 | 200–300 | Crack |
| 3 Reference | FIG. 11 | FIG. 21 | 0.120 | 0.120 | 81 | 8 | 0 | 150–250 | Crack |
| 4 Invention | FIG. 11 | FIG. 14 | 0.160 | 0.080 | 81 | 8 | 16 | Even at 500 or higher, no crack is formed, being in normal state. | |
| 5 Invention | FIG. 11 | FIG. 19 | 0.110 | 0.110 | 81 | 0 | 12 | 200–300 | Crack |

In Tables 3, 4, the caliber roll for rolling of same test number differs only in the hardness of its roll main body. In all caliber rolls for rolling in Table 3, the hardness of the roll main body is $H_RC$ 58, and in all caliber rolls for rolling in Table 4, the hardness of the roll main body is $H_RC$ 54. In all caliber rolls for rolling in Tables 3 and 4, the metal flow direction is the shaft central direction. The constructions of reference cases of test numbers 1, 3 in Tables 3, 4 are shown in FIGS. 20, 21, respectively. In both cases, the thickness of the shrinkage-fitting allowance 1*d* is uniform. In the example shown in FIG. 20, the roll shaft 2 of uniform diameter is inserted into the roll main body 1 having the caliber 1*a* and shaft hole 1*b* of uniform diameter, and in the example in FIG. 21, the roll shaft 2 of uniform diameter is inserted into the roll main body 1 having the caliber 1*a* and shaft hole 1*b* of uniform diameter and provided with the recess gap 1*c* contiguous to the shaft hole 1*b*.

As clear from the results in Tables 3, 4, in the case of the present invention embodiments (test numbers 2, 4) of applying compressive stress to the bottom of the caliber 1*a* of the roll main body 1 by combining the tapered roll shaft 2 with the roll main body 1 having the shaft hole 1*b* of uniform diameter, or in the case of the present invention embodiment (test number 5) of applying compressive stress to the bottom of the caliber 1*a* of the roll main body 1 by means of pressing jig (pressure ring 3), the roll life is about three or four times longer than that of the reference examples (test numbers 1, 3) without such compressive stress.

Besides, in each table, in the example (test number 4) of using the roll main body 1 having the recess gap 1*c* contiguous to the shaft hole 1*b*, the compressive stress caused by the action of the tapered roll shaft 2 is combined with the compressive stress caused by deflection of the roll by this recess gap 1*c*, and therefore the roll life is extended as compared with the example (test number 2) using the roll main body 1 without recess gap 1*c*.

Furthermore, as understood from the comparison between Table 3 and Table 4, the roll life is longer when the entire hardness of the roll main body 1 is $H_RC$ 54 (Table 3), as compared with $H_RC$ 58 (Table 4).

Using steel grades A, B, C in Table 1 differing in chemical composition as the materials, caliber rolls for rolling are manufactured by further varying the tempering conditions, and the rolling is tested by using them in rolling process, of which results are shown in Table 5.

In all caliber rolls for rolling in Table 5, the rolling conditions are same as in Table 2, and the type of the roll main body 1 is the type of FIG. 10 free from compressive stress due to deflection of roll without recess gap 1*c*, and the entire construction is the type of FIG. 20 free from compressive stress due to shrinkage-fitting. The reference examples of test numbers 14, 15 are not forged, and the metal flow is not in the shaft central direction, while the metal flow is in the shaft central direction in all other examples.

Comparing the invention and reference examples in Table 5, it is easily known that the caliber roll for rolling of the invention possesses an excellent life.

Furthermore, using the iron-based alloy having the chemical composition relating to the invention (specifically steel grade A or B in Table 1), and in the tempering conditions in the range of the invention, the caliber rolls for rolling of the type of causing compressive stress in the caliber are manufactured (specifically, the roll main body 1 is the type of FIG. 11, and the entire construction is the type of FIG. 14), and by these caliber rolls for rolling, the rolling process is conducted (the rolling conditions same as in Table 2). The rolling results are shown in Table 6.

TABLE 5

| Test No. | | Roll Meterial | ESR | OD of ingot (mm) | OD after forging (mm) | Spheroidizing condition | Hardening condition | Tempering condition |
|---|---|---|---|---|---|---|---|---|
| Reference | 1 | A | No | 800 | 310 | 850° C. × 5 hr | 1030° C. | 520° C. × 6 hr 2 times |

TABLE 5-continued

| | | | | | | | | |
|---|---|---|---|---|---|---|---|---|
| Invention | 2 | | | | | cooling in furnance | cooling in air | 540° C. × 6 hr 2 times |
| | 3 | | | | | | | 550° C. × 6 hr 2 times |
| | 4 | | | | | | | 560° C. × 6 hr 2 times |
| Reference | 5 | | | | | | | 570° C. × 6 hr 2 times |
| Invention | 6 | | Yes | | | | | 550° C. × 6 hr 2 times |
| Reference | 7 | B | | | | | | 550° C. × 6 hr 2 times |
| Invention | 8 | | | | | | | 560° C. × 6 hr 2 times |
| | 9 | | | | | | | 570° C. × 6 hr 2 times |
| | 10 | | | | | | | 580° C. × 6 hr 2 times |
| Reference | 11 | | | | | | | 590° C. × 7 hr 2 times |
| Invention | 12 | | Yes | | | | | 570° C. × 6 hr 2 times |
| Reference | 13 | C | No | | | 810° C. × 5 hr cooling in furnace | 850° C. cooling in oil (cored hardening) | 250° C. × 3 hr 2 times |
| | 14 | A | Yes | 320 | Not forged | 850° C. × 5 hr cooling in furnace | 1030° C. cooling in air | 550° C. × 6 hr 2 times |
| | 15 | B | | | | | | 570° C. × 6 hr 2 times |

| | Test No. | Product hardness ($H_RC$) | Rolling length until discarding ($\times 10^3$ m) | Cause of discarding | Remarks |
|---|---|---|---|---|---|
| Reference | 1 | 58 | 20–60 | Crack | Large crack (roll cutoff), short life, unstable |
| Invention | 2 | 56 | 70–120 | Crack | Large crack decreases |
| | 3 | 54 | 100–120 | Crack | Favorable working efficiency |
| | 4 | 52 | 100–120 | Crack | Favorable working efficiency |
| Reference | 5 | 51 | 30–60 | Pitting wear | Large wear, surface conditioning needed after about 20000 m |
| Invention | 6 | 51 | 300 or more | — | Favorable working efficiency |
| Reference | 7 | 58 | 20–60 | Crack | Large crack (roll cutoff), short life, unstable |
| Invention | 8 | 56 | 70–130 | Crack | Large crack decreases |
| | 9 | 54 | 100–120 | Crack | Favorable working efficiency |
| | 10 | 52 | 100–120 | Crack | Favorable working efficiency |
| Reference | 11 | 51 | 30–70 | Pitting wear | Large wear, surface conditioning needed after about 20000 m |
| Invention | 12 | 54 | 200 or more | — | Favorable working efficiency |
| Reference | 13 | Surface: 58 Inside: 35 | 25–45 | Crack | Crack, large crack occur in short time, wear is excessive, and sufficient surface conditioning needed after about 20000 m |
| | 14 | 54 | 10–40 | Crack | Large crack (roll cutoff), short life, unstable |
| | 15 | 54 | 10–40 | Crack | Large crack (roll cutoff), short life, unstable |

TABLE 6

| Test No. | | Roll material | ESR | OD of ingot (mm) | OD after forging (mm) | Spheroidizing condition | Hardening condition | Tempering condition | Product hardness ($H_RC$) |
|---|---|---|---|---|---|---|---|---|---|
| Invention | 1 | A | No | 800 | 310 | 850° C. × 5 hr cooling in furnace | 1030° C. cooling in air | 540° C. × 6 hr 2 times | 56 |
| | 2 | | | | | | | 550° C. × 6 hr 2 times | 54 |
| | 3 | | | | | | | 560° C. × 6 hr 2 times | 52 |
| | 4 | | Yes | | | | | 560° C. × 6 hr 2 times | 54 |
| | 5 | B | No | 800 | 310 | 850° C. × 5 hr cooling in furnace | 1030° C. cooling in air | 560° C. × 6 hr 2 times | 56 |
| | 6 | | | | | | | 570° C. × 6 hr 2 times | 54 |
| | 7 | | | | | | | 580° C. × 6 hr 2 times | 52 |
| | 8 | | Yes | | | | | 570° C. × 6 hr 2 times | 54 |

| Test No. | | Roll type | Shringkage-fitting allowance $\delta$ max | $\delta$ min | Stress A (kgf/mm$^2$) | Stress B (kgf/mm$^2$) | Rolling length until discarding ($\times 10^3$m) | Cause of discarding | Remarks |
|---|---|---|---|---|---|---|---|---|---|
| Invention | 1 | FIG. 14 | 1.60 | 0.080 | 8 | 16 | 150–300 | Crack | Favorable working efficiency |
| | 2 | FIG. 14 | 1.60 | 0.080 | 8 | 16 | 500 or more | — | Favorable working efficiency |

TABLE 6-continued

| | | | | | | | | |
|---|---|---|---|---|---|---|---|---|
| 3 | FIG. 14 | 1.60 | 0.080 | 8 | 16 | 300–400 | Wear | Favorable working efficiency |
| 4 | FIG. 14 | 1.60 | 0.080 | 8 | 16 | 500 or more | — | Favorable working efficiency |
| 5 | FIG. 14 | 1.60 | 0.080 | 8 | 16 | 150–300 | Crack | Favorable working efficiency |
| 6 | FIG. 14 | 1.60 | 0.080 | 8 | 16 | 500 or more | — | Favorable working efficiency |
| 7 | FIG. 14 | 1.60 | 0.080 | 8 | 16 | 300–400 | Wear | Favorable working efficiency |
| 8 | FIG. 14 | 1.60 | 0.080 | 8 | 16 | 500 or more | — | Favorable working efficiency |

In Table 6, stress A and stress B respectively denote the compressive stress caused by the recess gap of each roll, and the compressive stress caused by shrinkage-fitting, and the maximum tensile stress occurring during rolling is constant at 81 kgf/mm$^2$. In all caliber rolls for rolling presented for rolling process, an excellent resistance to wear and crack is confirmed.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims, or equivalence of such meets and bounds thereof are therefore intended to be embraced by the claims.

What is claimed is:

1. A manufacturing method of a roll main body for a caliber roll for rolling including a roll main body having a caliber on the outer circumference thereof and a shaft hole penetrating therein in the shaft central direction, and a roll shaft inserted into the shaft hole of said roll main body, comprising the steps of:

fabricating a columnar material of a specified outside diameter by screwing down a billet composed of an iron-based alloy including, by weight, C: 0.75 to 1.75%, Si: 3.0% or less Mn: 2.0% or less, P: 0.030% or less, S: 0.030% or less, Cr: 5.0 to 13.00%, Mo: 0.80 to 5.0%, V: 0.1 to 0.5%;

spheroidizing the fabricated columnar material by holding at 830° to 880° C. for three hours or more;

cutting out a disc of a specified width from the spheroidized material, and cutting and forming a shaft hole in the shaft central direction of the disc and a caliber in the outer circumference thereof; and hardening at 1000° to 1050° C., and tempering by holding at 540° to 590° C. for an hour or more and then cooling in air.

2. A manufacturing method of a roll main body of claim 1, wherein the hardness of said iron-based alloy is $H_RC$ 52 to 56.

3. A manufacturing method of roll main body of claim 1, wherein in the step of fabricating the columnar material, the billet is rolled in the axial direction by screwing down from the radial direction of the billet.

4. The method of claim 1, further comprising steps of:

inserting the roll shaft into the shaft hole of the roll main body, the roll main body having the shaft hole penetrating therein in an axial direction; and applying a compressive stress in a widthwise direction of said roll main body to a bottom of the caliber, the compressive stress being applied by forming first and second spaced-apart tapered sections either on an internal circumference of said roll main body or on a circumference of said roll shaft and shrinkage-fitting or cold-fitting said roll main body and said roll shaft, the first and second tapered sections having diameters which either both increase or both decrease as the tapered sections become closer and closer together in the axial direction.

5. The method of claim 4, further comprising:

forming a recess gap in a middle of the internal circumference of the shaft hole of said roll main body and a middle of the circumference of said roll shaft.

6. The method of claim 4, wherein the first and second tapered sections are formed so as to provide a shrinkage-fitting or cold-fitting allowance which gradually decreases from opposed end faces of the roll main body towards the central part of the roll main body.

7. The method of claim 4, wherein the first and second tapered sections are formed on the roll shaft and comprise portions of the roll shaft which decrease in diameter towards the central part of the roll main body.

8. The method of claim 7, wherein prior to the inserting step the shaft hole is formed so as to have a uniform diameter between opposed end faces of the roll main body.

9. The method of claim 4, wherein the first and second tapered sections are portions of the shaft hole which increase in diameter toward the central part of the roll main body.

10. The method of claim 9, wherein prior to the inserting step the roll shaft is formed so as to have a uniform diameter between opposed end faces of the roll main body.

11. The method of claim 4, wherein the roll main body is formed by rolling or forging a billet such that the billet is rolled or forged in the axial direction.

12. The method of claim 4, wherein the roll main body comprises a single piece of material.

13. The method of claim 4, wherein the shaft hole and the caliber are surfaces of a single piece of material.

* * * * *